US007009512B2

(12) United States Patent
Cordoba

(10) Patent No.: US 7,009,512 B2
(45) Date of Patent: Mar. 7, 2006

(54) ALARM SYSTEM FOR A PORTABLE DEVICE

(76) Inventor: Juan Carlos Cordoba, Satraangsvagen 2, 2tr 182 36, Danderyd (SE)

( * ) Notice: Subject to any disclaimer, the term of this patent is extended or adjusted under 35 U.S.C. 154(b) by 4 days.

(21) Appl. No.: 10/483,642

(22) PCT Filed: Jul. 4, 2002

(86) PCT No.: PCT/SE02/01345

§ 371 (c)(1),
(2), (4) Date: Jan. 13, 2004

(87) PCT Pub. No.: WO03/007257

PCT Pub. Date: Jan. 23, 2003

(65) Prior Publication Data

US 2004/0178907 A1 Sep. 16, 2004

Related U.S. Application Data

(60) Provisional application No. 60/305,566, filed on Jul. 13, 2001.

(51) Int. Cl.
*G08B 1/08* (2006.01)

(52) U.S. Cl. ..... 340/539.23; 340/568.7; 340/571; 340/705; 340/35

(58) Field of Classification Search ..... 340/539.21, 340/539.23, 539.32, 568.7, 572.1, 571; 705/35
See application file for complete search history.

(56) References Cited

U.S. PATENT DOCUMENTS 5,583,486 A * 12/1996 Kersten ..... 340/572.1
5,711,392 A 1/1998 Budel
5,742,233 A * 4/1998 Hoffman et al. ..... 340/573.1
5,757,271 A * 5/1998 Andrews ..... 340/568.1
5,867,103 A * 2/1999 Taylor, Jr. ..... 340/573.4
5,963,131 A * 10/1999 D'Angelo et al. ..... 340/568.1
6,011,471 A * 1/2000 Huang ..... 340/568.1
6,137,409 A * 10/2000 Stephens ..... 340/568.1
6,151,493 A 11/2000 Sasakura et al.
6,175,307 B1 * 1/2001 Peterson ..... 340/531
6,198,390 B1 3/2001 Schlager et al.
6,472,986 B1 * 10/2002 Sorriaux ..... 340/571
6,570,610 B1 * 5/2003 Kipust ..... 348/156
6,624,754 B1 * 9/2003 Hoffman et al. ..... 340/573.1

FOREIGN PATENT DOCUMENTS

| | | |
|---|---|---|
| DE | 29 915 915 | 8/2000 |
| EP | 0 417 944 | 3/1991 |
| EP | 1 098 205 | 5/2001 |
| FR | 2 543 715 | 10/1984 |
| GB | 2 132 804 | 7/1984 |
| GB | 2 248 331 | 4/1992 |

(Continued)

*Primary Examiner*—Jeffery Hofsass
*Assistant Examiner*—George Bugg
(74) *Attorney, Agent, or Firm*—Rolf Fasth; Fasth Law Offices

(57) ABSTRACT

The alarm system is for preventing loss or theft of a portable and/or movable device. The alarm system has a first portable and/or movable device provided with a first communication device operable for wireless communication with another communication device. A second portable and/or movable device is provided with a second communication device operable for wireless communication with another communication device. At least one of the first and second communication devices is configured to generate an alarm signal when a distance (D) between the first and second communication devices exceeds a predetermined distance (d).

2 Claims, 4 Drawing Sheets

FOREIGN PATENT DOCUMENTS

| | | | |
|---|---|---|---|
| GB | 2 310 251 | | 8/1997 |
| GB | 2 318 671 | | 4/1998 |
| GB | 2318671 A | * | 4/1998 |
| GB | 2 333 389 | | 7/1999 |
| GB | 2389216 A | * | 12/2003 |
| WO | WO 95 874 | | 1/1995 |
| WO | WO 98 16 412 | | 4/1998 |
| WO | WO 99 33 040 | | 7/1999 |
| WO | WO 00 37 958 | | 6/2000 |
| WO | WO 00 50 916 | | 8/2000 |

* cited by examiner

ALARM SYSTEM FOR A PORTABLE DEVICE

PRIOR APPLICATION

This application is a U.S. national phase application based on International Application No. PCT/SE02/01345, filed 4 Jul. 2002, claiming priority from U.S. Provisional Patent Application Ser. No. 60/305,566, filed 13 Jul. 2001.

TECHNICAL FIELD

The present invention relates in a first aspect to an alarm system for preventing loss or theft of a portable and/or movable device.

According to a second aspect the present invention relates to a method for preventing loss or theft of a portable and/or movable device.

According to a third aspect the present invention relates to at least one computer program product for preventing loss or theft of a portable and/or movable device.

BACKGROUND OF THE INVENTION

The document EP-A2-1 164 555 discloses a communication unit including a control device, which comprises a receiver to receive an enabling signal and a controller to enable operation of the communication unit in dependence upon the enabling signal. An active badge transmits the enabling signal. If the communication unit and the badge are separated and the communication unit is no longer able to receive the enabling, then the controller disables the communication unit. It is to be noted that the date of publication for this document is 2001 Dec. 19.

The document U.S. Pat. No. 5,635,897 discloses a mobile phone alarm which comprises a phone device to be attached to a mobile phone which repeatedly transmit a verification signal (an electromagnetic signal) of a limited power to be receivable within a limited, predetermined range. A body device is clipped or otherwise secured to the phone user, similar to a beeper, to receive the verification signal from the phone device. The body device generates an alarm signal once the user is at a distance from the mobile phone greater than the transmission range of the verification signal to notify the user.

The document JP-A-08044974 discloses a radio type portable forgetting machine, which consists of a pair of a transmitter and a receiver, and the transmitter amplifies a high frequency generated by a high frequency generating circuit by an amplifier and sends it as a radio wave from an antenna to the receiver. When a device using the same frequency is nearby, the frequency can be varied with a switch to prevent cross interference. The receiver confirms whether or not there is the radio wave from the transmitter and when the radio wave is ceased, a buzzer sounds; and the sent radio wave is caught and detected by a reception pact circuit, and a reception storage circuit stores whether or not there is a detection signal. Namely, whether or not the radio wave from the transmitter arrives is stored. The stored signal is supplied to a buzzer generating circuit, which makes the buzzer sound by confirming that the detection signal does not arrives.

The document WO-00/19390 discloses an alarm system for alerting a golfer about a forgotten club. A divot tool incorporates a radio transmitter powered by a rechargeable power source for transmitting a coded transmission. A radio receiver tuned to receive the coded transmission includes logic circuitry that generates an alarm signal whenever power associated with the coded transmission drops below a threshold level. One or more alarm devices are coupled to the logic circuitry to generate alarm(s) when the alarm signal is supplied thereto. A power source is coupled to the radio receiver for supplying power thereto and for supplying a charging current for the rechargeable power source via an electrical coupling. When a golfer places a club or other accessory on the ground, the divot tool is placed near the club. As long as the golfer remains within a prescribed range, no alarm will be activated. However, if the golfer moves further from the divot tool than the prescribed range, an alarm is produced. Alerted to his forgetfulness before leaving the vicinity, the golfer then simply retrieves the club and the divot tool.

None of the above cited documents discloses a complete solution to the problem of preventing loss or theft of e.g. a portable device. Another drawback with all but the last solutions given above is that they require the use of a mobile telephone.

SUMMARY OF THE INVENTION

It is an object of the present invention to solve the above mentioned problems.

According to a first aspect of the present invention there is provided an alarm system for preventing loss or theft of a portable and/or movable device. The alarm system comprises a first portable and/or movable device provided with a first communication means operable to communicate wireless with another communication means. The alarm system also comprises a second portable and/or movable device provided with a second communication means operable to communicate wireless with another communication means. At least one of said first and second communication means is configured to generate an alarm signal when a distance between said first and second communication means exceeds a predetermined distance. This alarm system can prevent loss or theft of any valuable item, or even persons. Consequently, this solution can be used to identify and localize persons and/or material items.

Preferably, at least one of said first and second communication means is configured to stop said alarm signal when the distance between said first and second communication means decreases and falls below said predetermined distance.

Advantageously, at least one of said first and second portable and/or movable device also comprises a locking means operable to lock said at least one portable and/or movable device when said alarm signal is trigged.

Preferably, at least one of said first and second portable and/or movable device being made non-functional when said alarm signal is trigged.

Advantageously, at least one of said first and second communication means is a chip.

Preferably, each said chip comprises a radio transmitting and receiving device using low power.

Advantageously, a current position of at least one of said first and second portable and/or movable device is determined with the aid of said communication means and a GPS system.

Preferably, each of said first and second portable and/or movable device can be in the form of a mobile telephone, a mobile communicator, a personal digital assistant, a hand-held computer, a portable computer, a wallet, a tag or a suitcase.

Advantageously, said predetermined distance can be adjusted.

Preferably, said alarm signal is in the form of a sound alarm signal, a visual alarm signal, or a vibration alarm signal, or an optional combination of the above mentioned signals.

Advantageously, one of said portable and/or movable device is mounted into a vehicle, and in that said device disables the electrical system in said vehicle when said alarm signal being trigged.

Preferably, one of said portable and/or movable device is a wallet, and the other portable and/or movable device is a mobile telephone, the mobile telephone will send a message, like an SMS, a voice message, an EMS, an MMS or similar, to e.g. a bank to stop a credit card, when said alarm signal being trigged.

Another object of the present invention is to provide a method for preventing loss or theft of a portable and/or movable device with the aid of an alarm system. The alarm system comprises a first portable and/or movable device provided with a first communication means operable to communicate wireless with another communication means, a second portable and/or movable device provided with a second communication means operable to communicate wireless with another communication means. The method comprises the steps of:

to establish wireless communication between said first and second communication means;

to continuously determine a distance between said first and second communication means; and to generate an alarm signal when said distance exceeds a predetermined distance. This method can prevent loss or theft of any valuable items, or even persons. Consequently, this solution can be used to identify and localize persons and/or material items.

Preferably, said method also comprises the step:

to stop said alarm signal when said distance between said first and second communication means decreases and falls below said predetermined distance.

Advantageously, said method also comprises the step:

to lock said at least one portable and/or movable device when said alarm signal being trigged.

Preferably, said method also comprises the step:

to make at least one of said first and second portable and/or movable device non-functional when said alarm signal being trigged.

Advantageously, each of said first and second communication means is a chip.

Preferably, said wireless communication is performed by a radio transmitting and receiving device using low power comprised in each said chip.

Advantageously, said method comprises the step:

to determine a current position of at least one of said first and second portable and/or movable device with the aid of said communication means and a GPS system.

Preferably, each of said portable and/or movable device can be in the form of a mobile telephone, a mobile communicator, a personal digital assistant, a handheld computer, a portable computer, a wallet, a tag or a suitcase.

Advantageously, said method also comprises the step:

to adjust said predetermined distance.

Preferably, said alarm signal is in the form of a sound alarm signal, a visual alarm signal, or a vibration alarm signal, or an optional combination of the above mentioned signals.

Advantageously, one of said portable and/or movable devices is mounted into a vehicle, wherein the method also comprises the step:

to disable the electrical system in said vehicle when said alarm signal being trigged.

Preferably, one of said portable and/or movable devices is a wallet, and the other portable and/or movable device is a mobile telephone, the method also comprises the step:

he mobile telephone will send a message, like an SMS, a voice message, an SMS, an MMS or similar, to e.g. a bank to stop a credit card, when said alarm signal being trigged.

Another object of the present invention is to provide at least one computer program product, directly loadable into the internal memory of at least one digital computer. Said at least one computer program product includes software code portions for performing the steps of the inventive method. This computer program product can prevent loss or theft of any valuable item, or even persons.

It will be noted that the term "comprises/comprising" as used in this description is intended to denote the presence of a given characteristic, step or component, without excluding the presence of one or more other characteristic features, integers, steps, components or groups thereof.

Embodiments of the invention will now be described with reference to the accompanying drawings, in which:

DETAILED DESCRIPTION

Figure 1:
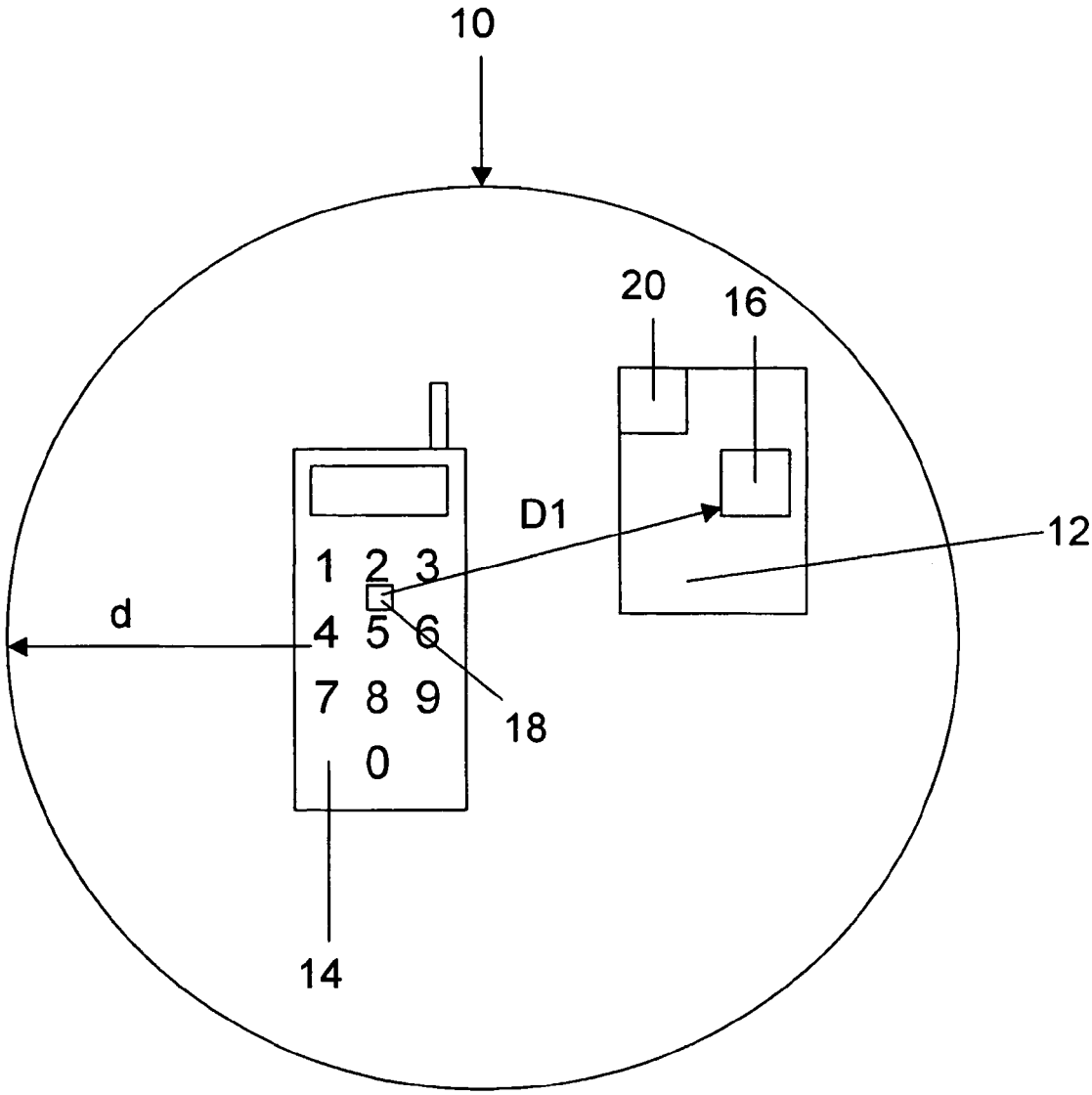
FIG. 1 is a schematic view of the alarm system of the present invention with the portable device inside the alarm periphery of a mobile telephone.
Figure 2:
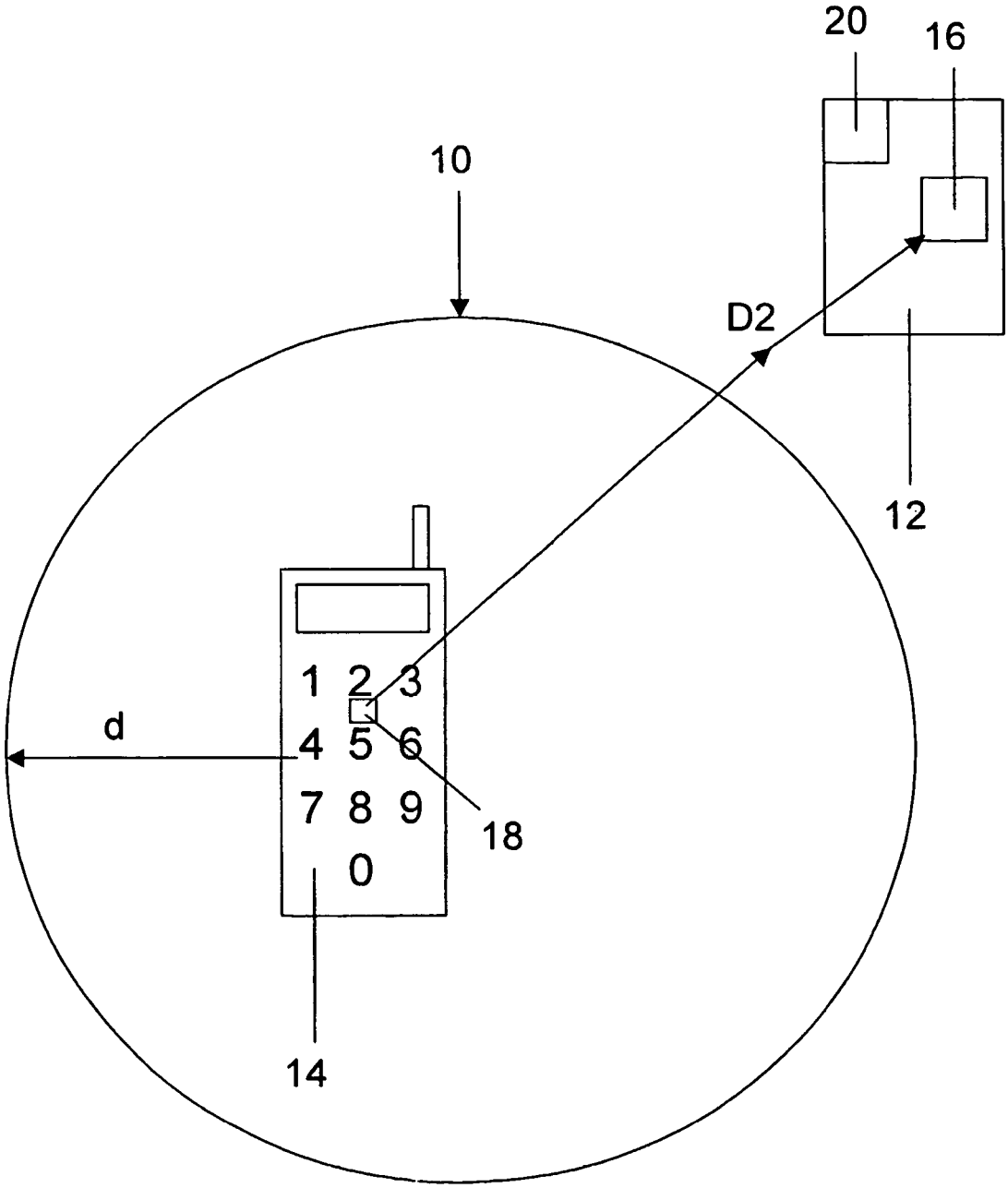
FIG. 2 is a schematic view of the alarm system with the portable device outside the alarm periphery of the mobile telephone.

With reference to FIGS. 1–2 the alarm system 10 of the present invention has a portable device 12 in wireless communication with a mobile telephone 14.

The portable device 12 may be a wallet, computer of any other valuable item. The device 12 is equipped with a micro-chip 16 that is in wireless communication with a micro-chip 18 of the mobile telephone 14. The chip 16 may be attached to or built into the device 12 so that it cannot be advertently removed by the user of the device 12. The chip 16 may also be built into a bag holding the device 12. Similarly, the chip 18 may also be attached to or built into the telephone 14. The operator of the telephone service for the telephone 14 may also provide functionalities that are similar to the functionalities provided by the chip 18 so that it is not necessary to have a physical chip mounted in the telephone 14. The chip 16 and the chip 18 may communicate with one another by using a Blue-tooth® technology or any other suitable wireless communication.

Chip 18 may be programmed to generate an alarm signal when the distance (D) between the chip 16 and the chip 18 exceed a certain distance (d). As shown in FIG. 1, the distance (D1) between the chip 16 and the chip 18 is less than the radius (d). As long as the chip 16 is located inside the circle formed by the radius d1 no alarm signal is triggered. However, when the chip 16 is moved outside the radius (d), as shown in FIG. 2, the alarm signal in the telephone 14 is triggered. It may be possible to adjust the triggering distance (d). For example, the distance could be varied between 10 centimetres to several meters if so desired.

One important function of the present invention is that the alarm system 10 may prevent the device 12, i.e. the wallet, to be stolen from the owner without the owner being alerted to the removal of the wallet. It may also alert the owner if the owner forgets the device 12 somewhere, such as on a table in a restaurant, since the alarm signal in the telephone is triggered as soon as the owner leaves the table in the restaurant. The telephone 14 may also be used to identify who a thief of the device 12 is because the alarm signal may be set to stop as soon as the telephone 14 is within the distance (d) of the device 12. Of course, the owner of the telephone 14 may also be alerted if the owner forgets the telephone 14 on the table as long as the owner wears the device 12 because the alarm signal of the telephone 14 is triggered. In the alternative, the device 12 may also be equipped with a sound device for generating the alarm signal. The alarm signalling function on the telephone 14 may be turned off so that the telephone 14 and the device 12 may be separated without triggering the alarm signal.

Should a thief of the device 12 escape from the owner despite the alarm signal, it may be possible to use a GPS system to later locate the device 12 by searching for the chip 16 built into the device 12. The device 12 may also be equipped with a locking device 20 that locks the device 12 when the alarm signal is triggered so that money and credit cards cannot be removed from the device 12 without destroying the device 12. If the device 12 is a computer, the computer may be made non-functional or locked when the alarm signal is triggered by the chip 16.

In accordance with a preferred embodiment of the present invention at least one of the first and second communication means 18, 16 is configured to stop the alarm signal when the distance (D) between the first and second communications means 18, 16 decreases and falls below the predetermined distance (d).

In another preferred embodiment of the present invention at least one of the first and second portable and/or movable device 14, 12 comprises a locking means 20 operable to lock said at least one portable and/or movable device 14, 12 when the alarm signal being trigged.

In another preferred embodiment of the alarm system at least one portable and/or movable device 14, 12 being made non-functional when said alarm signal being trigged.

In another preferred embodiment of the alarm system each of the of the first and second communication means 18, 16 is a chip 18, 16.

Each said chip 18, 16 can also comprise a radio transmitting and receiving device using low power, e.g. a Bluetooth® chip.

In another preferred embodiment of the alarm system 10 a current position of at least one of the first and second portable and/or movable device 14, 12 is determined with the aid of the communication means 18, 16 and a GPS system.

Each said portable and/or movable device 14, 12 can be in the form of a mobile telephone, a mobile communicator, a personal digital assistant, a handheld computer, a portable computer, a wallet, a tag or a suitcase.

In a preferred embodiment of the alarm system 10 the predetermined distance (d) can be adjusted.

The alarm signal can e.g. be in the form of a sound alarm signal, a visual alarm signal, or a vibration alarm signal, or an optional combination of the above mentioned signals.

In another preferred embodiment of the alarm system 10 one of portable and/or movable device 14, 12 is mounted into a vehicle, and the device 12; 12 disables the electrical system in said vehicle when the alarm signal being trigged.

Figure 3:
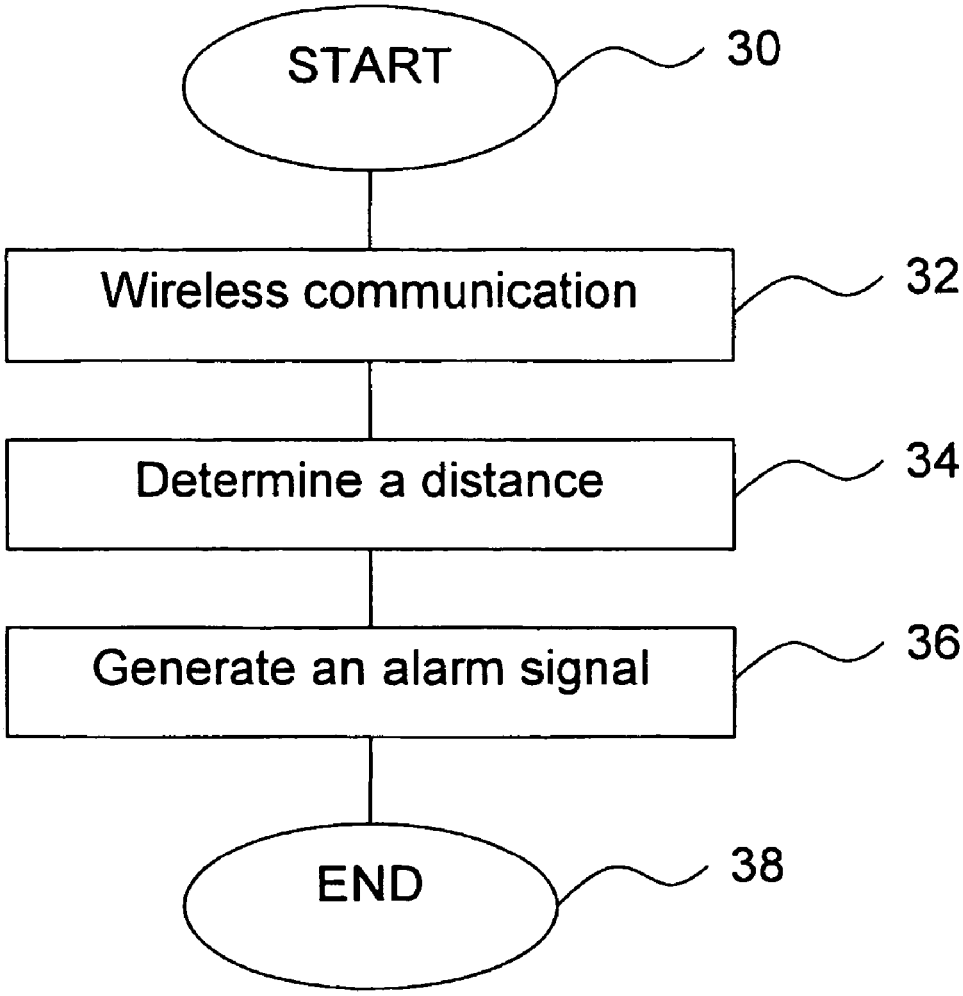
FIG. 3 is a flowchart illustrating a method for preventing loss or theft of a portable and/or movable device in accordance to the present invention.

In FIG. 3 there is disclosed a flowchart illustrating a method for preventing loss or theft of a portable and/or movable device in accordance to the present invention. The method is performed with the aid of an alarm system 10, comprising a first portable and/or movable device 14 provided with a first communication means 18, and a second portable and/or movable device 12 provided with a communication means 16. The method begins at block 30. The method continues, at block 32, with the step: to establish wireless communication between the first and second communication means 18, 16. Thereafter at block 34, the method continues with the step: to continuously determine a distance D between the first and second communication means 18, 16. The method continues, at the block 36, with the step: to generate an alarm signal when said distance D exceeds a predetermined distance d. The method is completed at block 38.

In a preferred embodiment of the method, it also comprises the step; to stop the alarm signal when the distance D between the first and second communication means 18, 16 decreases and falls below the predetermined distance d.

In another preferred embodiment of the method, it also comprises the step: to lock the at least one portable and/or movable device 14, 12 when the alarm signal being trigged.

In another preferred embodiment of the method, it also comprises the step: to make at least one of the first and second portable and/or movable device 14, 12 non-functional when the alarm signal being trigged.

In another preferred embodiment of the method, it also comprises the step: to determine a current position of at least one of the first and second portable and/or movable device 14, 12 with the aid of the communication means. 18, 16 and a GPS system.

In another preferred embodiment of the method, it also comprises the step: to adjust the predetermined distance d.

I another preferred embodiment of the method, one of the portable and/or movable devices 14, 12 is mounted into a vehicle. The method also comprises the step: to disable the electrical system in said vehicle when said alarm signal being trigged.

Figure 4:
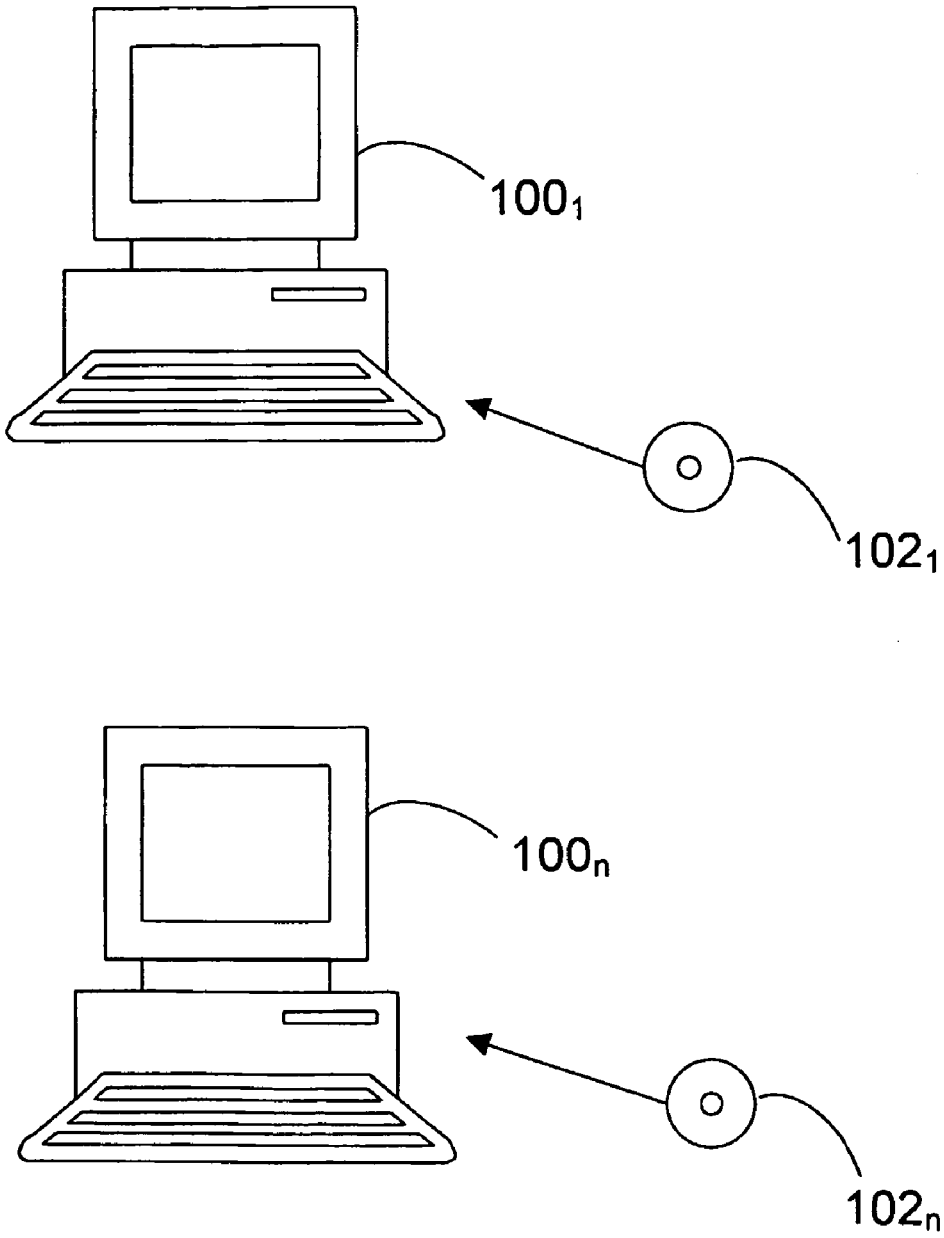
FIG. 4 illustrates schematically a number of computer program products according to the present invention.

FIG. 4 is a schematic illustration of some computer program products according to the present invention. The illustration discloses n number of different digital computers $\mathbf{100}_1, \ldots, \mathbf{100}_n$, wherein n is an integer. The illustration also discloses n number of computer program products $\mathbf{102}_1, \ldots, \mathbf{102}_n$, in the form of CD ROM disks. The different computer program products $\mathbf{102}_1, \ldots, \mathbf{102}_n$ can directly be downloaded into the internal memory of the n computers $\mathbf{100}_1, \ldots, \mathbf{100}_n$. Each computer program product $\mathbf{102}_1, \ldots, \mathbf{102}_n$ comprises software code portions for performing some or all the steps of FIG. 3 when the product/products $\mathbf{102}_1 \ldots, \mathbf{102}_n$ is/are run on said computer/computers $\mathbf{100}_1 \ldots, \mathbf{100}_n$. Said computer program products may, for instance be in the form of floppy disks, RAM disks, magnetic tapes, opto magnetical disks or any other suitable products.

In the embodiment when one of said portable devices 14; 12 is a wallet and the other portable device 12, 14 is a mobile telephone, the mobile telephone will send a message, like an SMS, voice message, an EMS (Enhanced Message Service), an MMS (Multimedia Message Service) or similar, when said alarm signal being trigged. this message can e.g. be sent to a bank to stop a credit card.

It is also possible with this embodiment that the bank confirm that the card is stopped, and give transaction and the status of an account to the user via the mobile telephone.

It is also possible with this embodiment that the bank also received information regarding the place where the wallet being lost and the time when this happened.

In the embodiment when one of said portable devices 14 is a PDA, and the other portable device 12 is a mobile telephone, can e.g. all the content in the memory in the PDA be erased when the alarm signal being trigged.

It is also possible with this embodiment that all the content in the memory in the PDA being encrypted when the alarm signal being trigged.

In the embodiment when one of said portable devices 14, 12 is e.g. a dispatch case, a mechanical relay is activated when the alarm signal being trigged, which mechanical relay ruptures a dye cartridge contained in the dispatch case colouring the content in the dispatch case.

In the embodiment when one of said portable devices 14; 12 is a tag, the tag can be worn by e.g. a child or an animal. The tag can also be placed on an umbrella, a book or a carrier bag.

It will be understood that the invention is not restricted to the above mentioned embodiments, and that the person skilled in this art will be aware of that many modifications are possible within the scope of the accompanying claims.

What is claimed is:

1. An alarm system for preventing loss or theft of a portable and/or movable device, wherein the alarm system comprises a first portable and/or movable device provided with functionalities of a first communication means operable to communicate wireless with another communication means, a second portable and/or movable device provided with a second communication means operable to communicate wireless with another communication means, wherein at least one of said first and second communication means is configured to generate an alarm signal when a distance (D) between said first and second communication means exceeds a predetermined distance (d), one of said portable and/or movable device being a wallet, and the other portable and/or movable device being a mobile telephone, the mobile telephone sending a short message service message, a voice message, an enhanced message service message, a multimedia message service message or a message to a bank to stop a credit card, when said alarm signal is triggered.

2. A method for preventing loss or theft of a portable and/or movable device with the aid of an alarm system, comprising a first portable and/or movable device provided with functionalities of a first communication means operable to communicate wireless with another communication means, a second portable and/or movable device provided with a second communication means operable to communicate wireless with another communication means, wherein the method comprises the steps of:

establishing wireless communication between said first and second communication means;

continuously determining a distance (D) between said first and second communication means;

generating an alarm signal when said distance (D) exceeds a predetermined distance (d), one of said portable and/or movable devices being a wallet, and the other portable and/or movable device being a mobile telephone, and the mobile telephone sending a short message service message, a voice message, a multimedia message service message or a message to a bank to stop a credit card, when said alarm signal is triggered.

* * * * *